United States Patent [19]

Kulesa

[11] 3,985,261

[45] Oct. 12, 1976

[54] TAB HOLD-DOWN

[75] Inventor: Edmund M. Kulesa, South Holland, Ill.

[73] Assignee: Continental Can Company, Inc., New York, N.Y.

[22] Filed: July 14, 1975

[21] Appl. No.: 595,641

[52] U.S. Cl. ..... 220/270; 220/359

[51] Int. Cl.[2] ..... B65D 41/32

[58] Field of Search..... 220/270, 359, 260, 94 R; 229/7 R; 215/253, 254; 222/541

[56] References Cited

UNITED STATES PATENTS

| | | | |
|---|---|---|---|
| 3,401,821 | 9/1968 | Bozek | 220/270 |
| 3,659,739 | 5/1972 | Luviano et al. | 220/270 |
| 3,908,857 | 9/1975 | Chiappe | 220/359 |

*Primary Examiner*—George T. Hall
*Attorney, Agent, or Firm*—John J. Kowalik; Joseph E. Kerwin; William A. Dittmann

[57] ABSTRACT

A releasable fastening for the ring portion of a tape tab to the body portion of the tab. The tab is a laminate of plastic and metal and is folded along its longitudinal edge to form a hem which not only increases the tensile strength of the tab and prevents tearing but, also, inverts the plastic, which is normally on the bottom of the tab, along opposite edges to provide plastic strips extending lengthwise of the tab. The ring portion is also hemmed and, in being folded onto the body portion, disposes the plastic strips on its edges against the plastic strips on the body portion. The opposing plastic hem strips are heated and clamped together to produce a fracturable attachment to temporarily hold the ring portion flat against the body portion which lays flat on the end panel. When the ring portion is pulled up preparatory to peeling the tape off the can end to which it is attached, the attachments fracture and allow the ring portion to be pulled up.

10 Claims, 4 Drawing Figures

TAB HOLD-DOWN

DISCUSSION OF THE PRIOR ART

Applicant is not aware of any prior art in which the ring portion is temporarily secured to the body portion of the tab by the plastic material forming the tab laminate.

The instant invention is designed to hold the ring portion flat against the body portion of the tape to prevent interference with the seaming mechanism when the end, to which the tape is applied, is connected to the container.

Also the hold-down attachment prevents mutilation of the tape, which is formed of dead soft aluminum and plastic such as polypropylene, during handling of the can ends while in transport and manufacture.

SUMMARY OF THE INVENTION

The invention is directed to a pull tab hold-down wherein portions of the tab which are formed of metal and plastic are folded and butt welded plastic to plastic to hold different parts of the tab in predetermined relationship to each other.

A specific object is to provide a tape tab wherein a laminate of plastic and metal is folded along its edges to provide a hem, the plastic parts of which are turned toward each other and heat welded together to hold to ring portion of the tab to the body portion.

These and other objects and inventions inherent in, and encompassed by the invention will become more apparent from the specification and the drawings, wherein.

DESCRIPTION OF THE INVENTION

Figure 1:
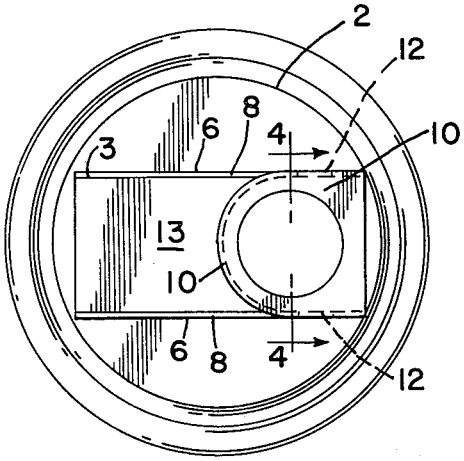
FIG. 1 is a top plan view of an end element incorporating the invention.
Figure 2:
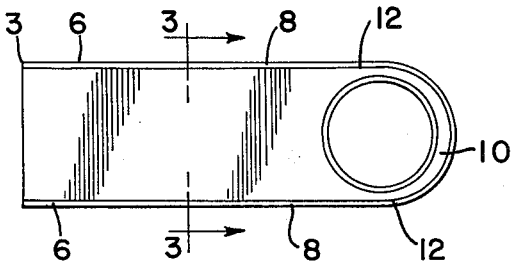
FIG. 2 is a top plan view of the novel tape tab shown in unfolded position.
Figure 3:
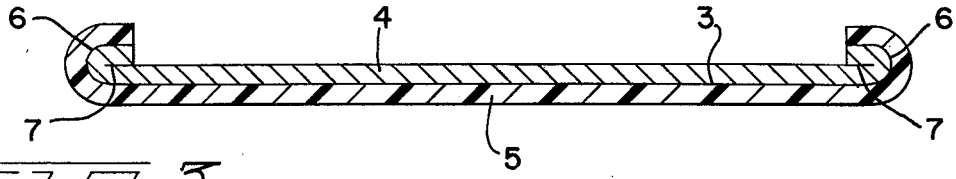
FIG. 3 is an enlarged cross-sectional view taken substantially on line 3—3 of FIG. 2.
Figure 4:
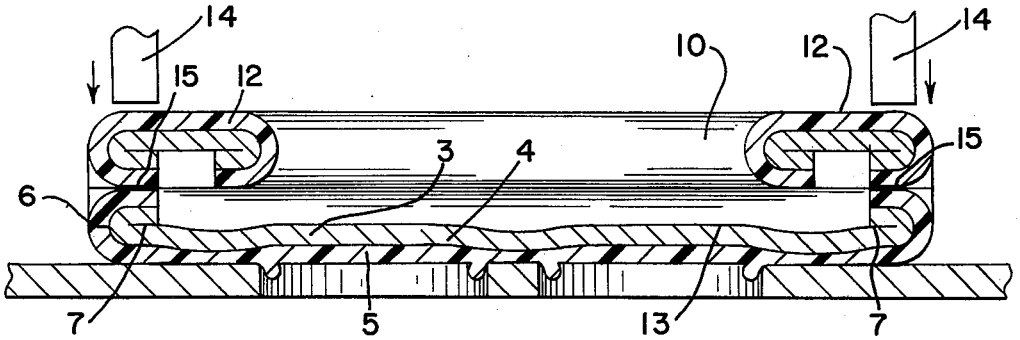
FIG. 4 is an enlarged cross-sectional view taken substantially on line 4—4 of FIG. 1.

The invention is shown in association with a metal end panel 2 although the panel may be plastic or nonmetal.

The tape 3 is a rectangular laminate comprising a soft metal film 4 such as dead soft aluminum and plastic film 5 such as polypropylene each about 0.001 inch thick.

The tab is provided with a hem 6 along each longitudinal edge by a fold 7 of the laminate whereby the plastic which is normally on the bottom and adhered to the can top, as best explained in Kerwin & Erlandson, U.S. application Ser. No. 507,036, is turned up as a strip 8 along each side of the tape. The ring portion 10 of the tape is hemmed about its edge at 12 as a continuation of the hem 6. The ring or grasp portion 10 is folded over the body portion 13 and the hem strips 8 on the opposite sides of the ring overlap and vertically align with the adjacent strip portions 12 of the ring.

A heated element such as a rod 14,14 (not shown) is pressed down on the ring portions causing the plastic in the adjacent areas 15, 15 to melt sufficiently to bond and tack weld together so that when the rods are removed these areas cool quickly and coalesce bonding the ring to the body portion. The ring upon being pulled up breaks the bond at 15 permitting the ring to be pulled up and thus peel the tape off the end panel.

Thus a novel, simple and inexpensive structure has been provided which not only strengthens the tape but also provides a simple and effective means for holding down the tab.

What is claimed is:

1. A pull tab comprising an elongated laminate member made of metal foil and thermoplastic film and having longitudinal edges, a fold along each edge of the member providing strips of plastic superposed with respect to said metal foil, said tab having a body portion and a grasp portion folded over said body portion and having said plastic strips thereon opposing the respective strips of plastic on the body portion, and fracturable tack weldments between the opposing strips for temporarily holding said grip portion flat against said body portion.

2. The invention according to claim 1 and said plastic being a polyolefin.

3. The invention according to claim 2 and said plastic being a polypropylene.

4. The invention according to claim 1 and said metal being dead soft aluminum.

5. The invention according to claim 1 and said grip portion being a pull ring.

6. A pull tab of the type adapted to be adhesively adhered flatwise to a container end panel and comprising a flat laminate having a reverse side comprising a thermoplastic film and obverse side comprising a metal foil, said tab having a body part and a grasp part folded over said obverse side of said body part, said tab having inverted portions positioning plastic sections on said parts on the obverse side of said parts and in the folded position of said parts said portions having plastic sections thereon in facing opposing relation, and means releasably bonding said plastic sections on said portions to each other.

7. The invention according to claim 6 and said inverted portions comprising strengthening hems about the periphery of the tab.

8. The invention according to claim 6 and said releasable bonding means comprising melt-weldments of the plastic.

9. The invention according to claim 6 and said plastic being a polyolefin.

10. The invention according to claim 6 and said metal foil comprising aluminum and said plastic being polypropylene.

* * * * *